US005105503A

United States Patent [19]

Holland

[11] Patent Number: 5,105,503

[45] Date of Patent: Apr. 21, 1992

[54] CLEANING HEAD

[75] Inventor: John A. Holland, Winthrop, Australia

[73] Assignee: Vax Appliances (Australia) Pty Ltd, Riverdale, Australia

[21] Appl. No.: 499,297

[22] PCT Filed: Nov. 17, 1988

[86] PCT No.: PCT/AU88/00447

§ 371 Date: May 17, 1990

§ 102(e) Date: May 17, 1990

[87] PCT Pub. No.: WO89/04627

PCT Pub. Date: Jun. 1, 1989

[30] Foreign Application Priority Data

Nov. 18, 1987 [AU] Australia ..... PI5496
Jan. 22, 1988 [AU] Australia ..... PI6413

[51] Int. Cl.[5] ..... A47L 11/34
[52] U.S. Cl. ..... 15/322; 15/321
[58] Field of Search ..... 15/321, 322

[56] References Cited

U.S. PATENT DOCUMENTS 3,747,155 7/1973 Koellisch ..... 15/322
4,185,354 1/1980 Brazier ..... 15/321
4,270,238 6/1981 Shallenberg et al. ..... 15/322 X

FOREIGN PATENT DOCUMENTS 3633111 3/1988 Fed. Rep. of Germany .
2604079 3/1988 France .
1121225 7/1968 United Kingdom .
1167239 10/1969 United Kingdom .
1291138 9/1972 United Kingdom .
1601455 10/1981 United Kingdom .
90/30142 4/1990 World Int. Prop. O. .

*Primary Examiner*—Chris K. Moore
*Attorney, Agent, or Firm*—Spencer, Frank & Schneider

[57] ABSTRACT

An elongate cleaning head; including a suction chamber having an open mouth and a centrally disposed outlet for connection to a source of suction; and an inner compartment extending substantially medially within the suction chamber and having side walls defining an open mouth substantially in the plane of the open mouth of the suction chamber, the inner compartment having associated therewith a cleaning liquid distributing chamber formed with a plurality of closely spaced fine outlet passageways adapted to allow cleaning liquid to flow into the inner compartment at a position spaced from the mouth thereof, wherein the suction chamber is divided into two laterally spaced suction zones by means of a central baffle which diverges in a direction away from the open mouth of the suction chamber towards an upper zone of the suction chamber into which upper zone said outlet opens.

11 Claims, 3 Drawing Sheets

III
A
B
C

CLEANING HEAD

CROSS-REFERENCE TO RELATED APPLICATION

The subject matter of the present Application is closely related to that of Applicant's copending Application Ser. No. 07/499,298, filed May 17th, 1990.

BACKGROUND OF THE INVENTION

1. Field of the Invention

This invention relates to a cleaning head for use with an apparatus for cleaning floors, walls, carpets, curtains, upholstery and the like, and more particularly concerns a cleaning head for use in the process of water extraction cleaning, in which a carpet or the like is thoroughly wetted by a solution containing a suitable cleansing agent, such as a non-foaming detergent, and the carpet or the like is then dried by the uptake of that solution by means of suction. Such a cleaning head is the subject of our British Patent No. 1601455 and the present invention concerns a development of the design disclosed therein.

SUMMARY OF THE INVENTION

According to the present invention we provide an elongate cleaning head comprising a suction chamber having an open mouth and a centrally disposed outlet for connection to a source of suction, and an inner compartment extending substantially medially within the suction chamber and having side walls defining an open mouth substantially in the plane of the open mouth of the suction chamber, the inner compartment having associated therewith a cleaning liquid distributing chamber formed with a plurality of closely spaced fine outlet passageways adapted to allow cleaning liquid to flow into the inner compartment at a position spaced from the mouth thereof, wherein the suction chamber is divided into two laterally spaced suction zones by means of a central baffle which diverges in a direction away from the open mouth of the suction chamber towards an upper zone of the suction chamber into which upper zone said outlet opens.

The divided suction chamber with the upwardly divergent baffle causes the air flow through the head from the open mouth to the outlet to be split into two streams which diverge away from the centre of the head in the respective suction zones and then converge towards the outlet in the upper zone of the head. This arrangement makes it possible to increase the transverse width of the head without reducing the efficiency of the liquid pick-up operation and without increasing the overall air flow requirement. Thus in practice, the use of a cleaning head in accordance with the present invention typically makes it possible to utilise a cleaning head having a width of approximately 20 cm (8 inches) without increasing the air flow requirement over that which would otherwise be required for a 12.5 cm (5 inch) head whilst maintaining equivalent efficiency of operation.

In accordance with a further feature of the invention the inner compartment is formed or provided with a separating wall dividing it into an outer liquid delivery chamber adjacent to said open mouth of the inner compartment and an inner chamber which serves as said liquid distributing chamber, said outlet passageways being formed in said separating wall.

Preferably said liquid distribution chamber is so dimensioned to serve as a storage reservoir within the cleaning head, for the cleaning liquid, which reservoir has a height sufficient to create a substantially equal hydrostatic head pressure at each of the outlet passageways. Typically the height of the reservoir may be at least 10 mm.

Preferably said liquid distribution chamber has sufficient volume such that when substantially full a substantially equal flow rate of cleaning liquid from each of the outlet passageways can be achieved during application of the open mouth to a surface. Typically, the volume may be approximately 1 cc per linear centimeter of the head.

The open mouth of the inner compartment is preferably of elongate configuration and said inner compartment preferably extends across the suction chamber substantially parallel to the main axis thereof.

The open mouth of said inner compartment is preferably located substantially centrally within the open mouth of the suction chamber whereby air-flow into the suction chamber takes place on both sides of the open mouth of the inner compartment, and the upper side of the body is preferably spaced above the upper side of the inner compartment by such a distance as to allow substantially unrestricted air-flow towards the outlet from both sides of the inner compartment.

According to a further preferred feature of the invention said inner compartment may be formed as a separate unit which is removable from the suction chamber, although it may alternatively be formed integrally.

The present invention further resides in an improved suction cleaning head comprising a body defining a suction chamber having a boundary wall defining an open mouth and having an outlet adapted to be connected to an air extraction means, and an inner compartment extending across the suction chamber and having a substantially planar open mouth parallel or co-planar with the open mouth of the suction chamber, wherein said inner compartment is formed or provided with a separating wall dividing it into an outer liquid delivery chamber adjacent to said open mouth of the inner compartment and an internal liquid distribution chamber which extends across the suction chamber and which has an inlet adapted to be connected to a supply of cleaning liquid, and a plurality of flow passageways are provided which extend through said separating wall between the liquid reception chamber and the liquid delivery chamber.

The invention further resides in a separable inner housing for a suction cleaning head and comprising an elongate body affording an elongate open mouth, the housing being formed or provided with a separating wall dividing it into an outer liquid delivery chamber adjacent to said open mouth and an inner liquid distributing chamber having a liquid inlet, said separating wall being formed with a plurality of fine outlet passageways at closely spaced intervals along the length thereof to allow liquid to flow from said liquid distributing chamber into said liquid delivery chamber at a position spaced from the open mouth.

BRIEF DESCRIPTION OF THE DRAWING

These and other features of the present invention will now be described by way of example with reference to the specific embodiments illustrated in the accompanying drawings wherein.

DESCRIPTION OF THE PREFERRED EMBODIMENTS

Figures 1, 2, 3:
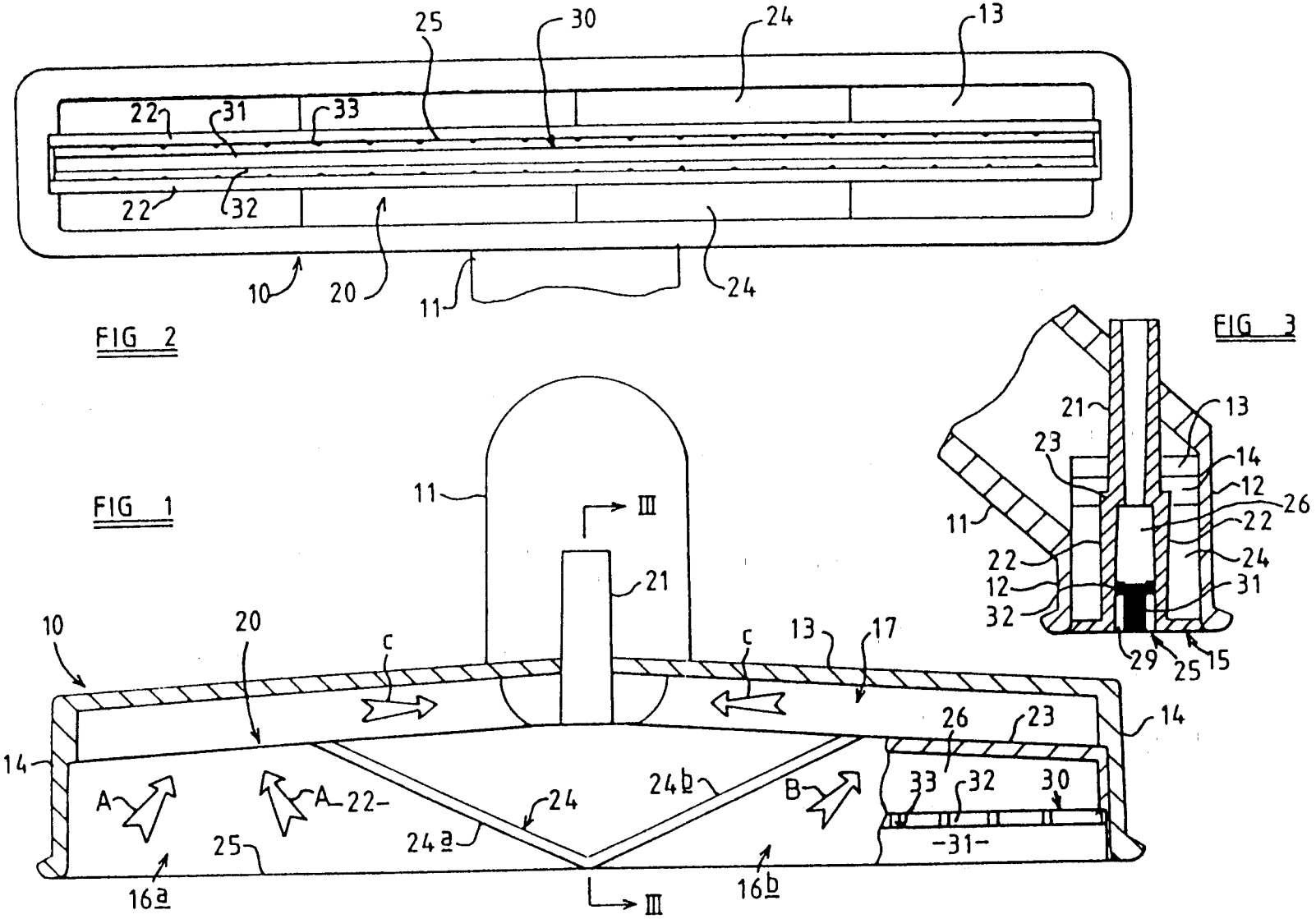
FIG. 1 shows a first embodiment of cleaning head in a part-sectional front elevation.
FIG. 2 shows an underneath plan view thereof.
FIG. 3 shows a vertical section on the line III—III of FIG. 1.
Figure 4:
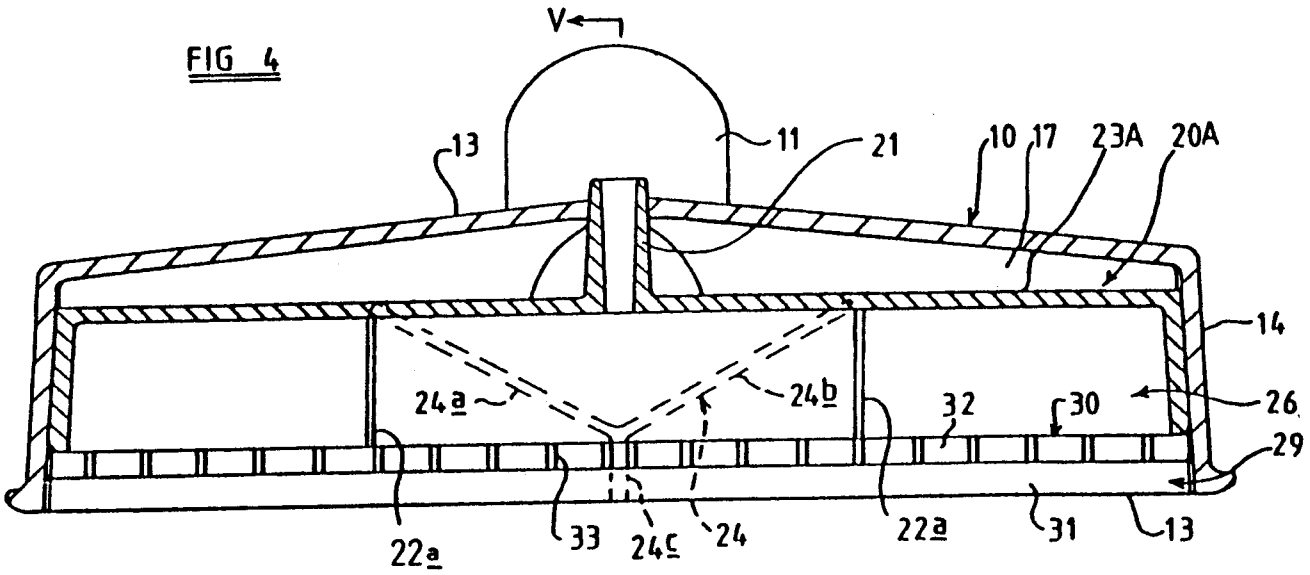
FIG. 4 shows a second embodiment of cleaning head in a part sectional front elevation.
Figure 5:
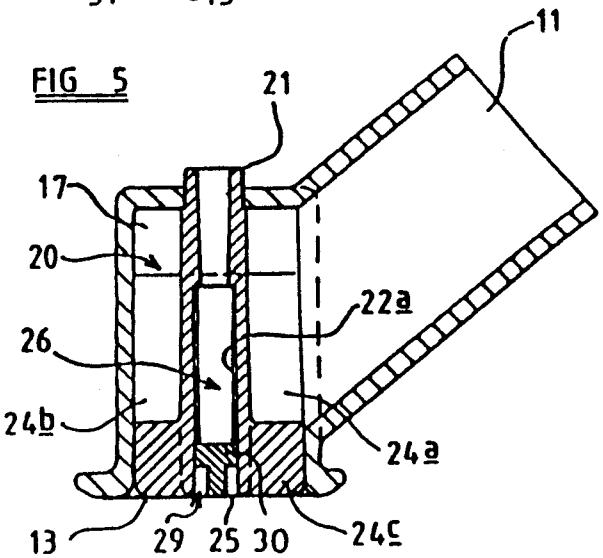
FIG. 5 shows a vertical section on the line V—V of FIG. 4.
Figure 7:
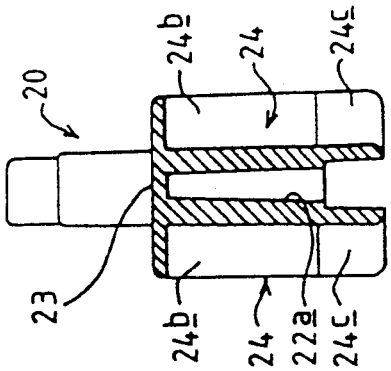
FIG. 7 is a cross-section on the line VII—VII of FIG. 6.
Figure 10:
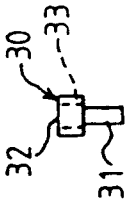
FIG. 10 is an end view of the T-section bar.
Figure 6:
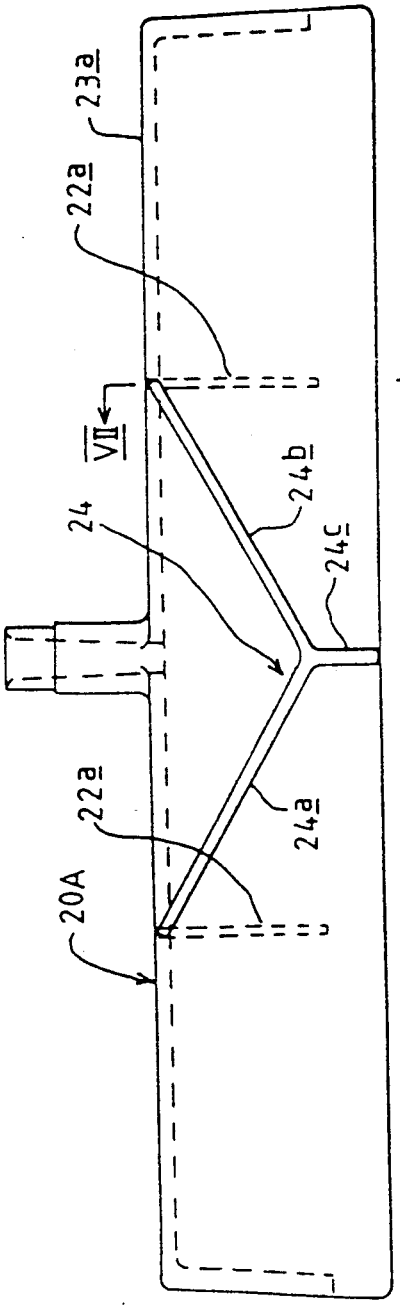
FIG. 6 is a side view of an inner housing for cleaning head as shown in FIGS. 4 and 5.
Figure 9:
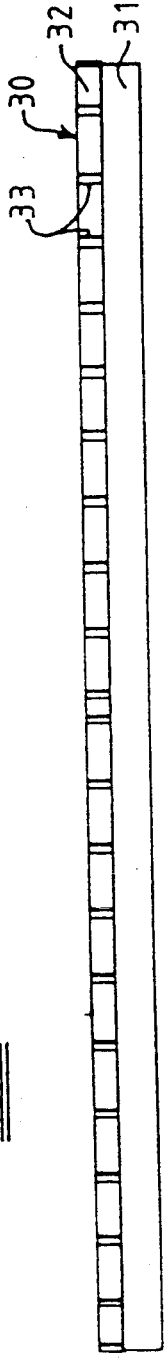
FIG. 9 is a side view of a T-section bar which fits into the inner housing shown in FIG. 6.
Figure 8:
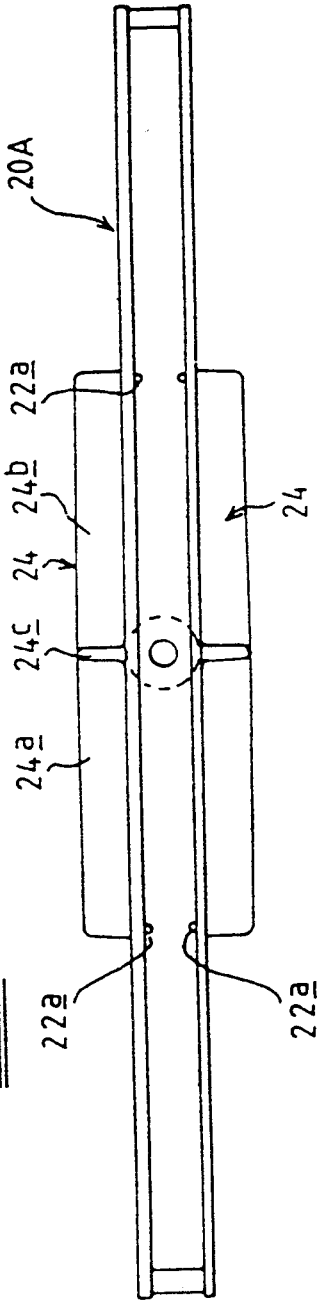
FIG. 8 is an underneath plan view of the inner housing shown in FIG. 6.

The first embodiment of cleaning head in accordance with the invention as illustrated in FIGS. 1 to 3 comprises an elongate outer housing 10 with a centrally disposed tubular outlet spigot 11 for attachment to the suction hose (not shown). The outer housing 10 receives therein a structurally separate medially extending inner housing 20 having side walls 22 which are spaced from side walls 12 of outer housing and an upper wall 23 which is spaced from the upper wall 13 of the outer housing. The side walls 22 of the inner housing 20 each carry a shallow V-formation rib 24 including wings 24*a*, 24*b* which bridge the space between the side walls 22 of the inner housing and the side walls 12 of the outer housing.

As can be seen from FIG. 1, the wings 24*a*, 24*b* diverge upwardly away from open mouth 15 of the outer housing and outwardly from the centre. The ribs 24 serve as baffles whereby a suction chamber defined by the outer housing 10 is divided into two laterally spaced suction zones 16*a*, 16*b* in which air drawn in through the open mouth 15 is divided into two divergent streams as indicated by arrows A and B. The ribs 24 terminate at positions approximately half way between the centre line and end walls 14 of the outer housing, so that the air flows enter an upper zone 17 of the outer housing above the inner housing 20 and converge towards the outlet spigot 11 as indicated by arrows C.

The portion of inner housing 20 adjacent to the open mouth 25 thereof accommodates a T-section bar member 30 whereof a transverse web 32 is received innermost and is supported at the ends of the inner housing 20 by engagement within recessed portions of the end walls thereof. Central leg 31 of the T-section bar member 30 extends downwardly from the web 32 and terminates in the plane of the open mouth 25 of the inner housing 20.

The lateral edges of the transverse web 32 of the T-section bar member 30 are formed with a plurality of spaced calibrated grooves 33 which extend between each face thereof. The transverse web 32 of the T-section bar member 30 forms a separating wall which divides the inner housing 20 into an internal liquid distribution chamber 26 above the transverse web 32 and an outer liquid delivery chamber 29 below the transverse web 32, between which chambers communication is provided through the grooves 33. The chamber 26 within the inner housing above the bar 30 has a volume such that it serves as a reservoir for the reception of a cleaning solution which is supplied through a pipe (not shown) to an inlet spigot 21 which protrudes from the inner housing as shown in FIGS. 1 and 3, whereby when substantially full there is a substantially equal rate of delivery from each passageway 33 under equal hydrostatic pressure.

The calibrated grooves 33 are provided at spaced intervals along substantially the entire length of the edges of the web 32 to regulate the flow of liquid so as to cause it to be delivered uniformly and continuously at an appropriate rate. Typically, apertures 33 have a width of about 0.5 mm and are spaced on 10 mm centres. The cleaning solution may be supplied by any appropriate means to the chamber 26, which may typically have a height of at least 1 cm and a volume of about 1 cc per centimeter of its length.

In particular, the head illustrated in FIGS. 1 to 3 is designed for use with substantially non-pressurised liquid delivery systems. Thus, the liquid may be supplied gravitationally, or by a syphon system, in either case optionally assisted by a slight positive pressure generated for example by the application of exhaust air from the suction cleaner fan to a liquid reservoir in the manner disclosed in our British patent No. 1601456.

The space within the inner housing below the transverse flange 32 of the bar 30 defines the liquid delivery chamber 29 which extends medially of the outer housing 10. The arrangement of the end faces of the side walls 22 in the same plane as the mouth of the outer housing 10 ensures that such inner compartment is substantially sealed against the fabric being treated and that there is virtually no possibility of the liquid passing through the grooves 33 being drawn away directly by virtue of the air flow established within the head. Instead, the liquid is shielded by the side walls 22 and is constrained by the side walls to flow onto the fabric being cleaned. In this way, a thorough wetting of the fabric is ensured without spraying. This in turn makes it possible for the appliance to operate with only a low pressure gradient acting on the liquid, and without the need for any pump for the delivery of cleaning liquid to the head under substantial pressure.

The divided air flow resulting from the ribs 24 ensures that substantially uniform suction is applied over the entire length of the head, which can thus be made sigificantly greater than in the absence of such ribs without requiring an increase in the overall air flow and without employing a correspondingly more powerful motor to drive the fan of the suction cleaner.

As can be seen most clearly from FIG. 3 the space above and around the inner housing 20 is such as to provide substantially unimpeded air-flow through the suction chamber on both sides of the inner housing, and over the top thereof into the upper zone 17 of the outer housing 10 and thence to the outlet 11.

The second embodiment shown in FIGS. 4 to 10 is of generally similar form to that of the first embodiment described above and the same reference numerals are used to denote corresponding parts, the following description being largely confined to features of difference.

Outer housing 10A of the second embodiment is somewhat deeper than theat of the first embodiment and inner housing 20A is also deeper than that of the first embodiment with a flat upper wall 23A.

The modified inner housing 20A as illustrated in FIGS. 6 to 10 is generally similar in construction to the inner housing 20 previously described, except in the following respects.

The wings 24*a*, 24*b* of the shallow V-shape ribs 24 do not extend directly to the lower edge of the inner housing, but an additional, vertical wing 24*c* extends downwardly from the point at which the wings 24*a*, 24*b* meet and terminates at the lower edge of the housing 20A.

Internal ribs 22*a* are formed on the side walls of the housing 20A and terminate as shown at positions spaced inwardly from the open mouth of the housing. The ribs 22*a* serve to locate the T-section bar 30 within the housing 20A.

If desired, the inner housing may be formed as a set of modules which can be interengaged in end-to-end relationship and to be receivable within suction heads of a variety of dimensions as required. By the use of such separate modules, a conventional suction head may be adapted for use for wet cleaning of floor surfaces.

Moreover, whilst in the illustrated embodiments a single V-formation rib 24 is formed on each side of the inner housing in a central region thereof, it may be appropriate to provide additional V-formation ribs at positions offset from the central region towards the ends of the housing, particularly for heads of increased width.

What is claimed is:

1. An elongate cleaning head, comprising:

a suction chamber having an open mouth and a centrally disposed outlet for connection to a source of suction; and an inner compartment extending substantially medially within the suction chamber and having side walls defining an open mouth substantially in the plane of the open mouth of the suction chamber, the inner compartment having associated therewith a cleaning liquid distributing chamber formed with a plurality of closely spaced fine outlet passageways adapted to allow cleaning liquid to flow into the inner compartment at a position spaced from the mouth thereof, wherein the suction chamber is divided into two laterally spaced suction zones by means of a central baffle which diverges in a direction away from the open mouth of the suction chamber towards an upper zone of the suction chamber into which upper zone said outlet opens.

2. The cleaning head according to claim 1, wherein said baffle comprises a rib of shallow V-shape with two upwardly diverging wings.

3. The cleaning head according to claim 2, wherein said upwardly diverging wings meet substantially in the plane of the open mouth of the suction chamber.

4. The cleaning head according to claim 2, wherein said baffle comprises a third wing extending downwardly from the point at which said two wings meet and terminating substantially in the open mouth of said suction chamber.

5. The cleaning head according to claim 1, wherein said inner compartment and said baffle are formed as a single unit which is structurally separate from and releasably received in, said suction chamber.

6. The cleaning head according to claim 5, wherein the inner compartment is afforded by an inner housing which has located therein a structurally separate dividing member which is formed with said fine outlet passageways and divides said inner housing so as to define therein said distributing chamber.

7. The cleaning head according to claim 1, wherein the inner compartment is formed as a liquid delivery chamber in an inner housing which is divided by a separating wall into an outer liquid delivery chamber and an inner chamber which serves as said liquid distributing chamber, said outlet passageways being formed in said separating wall.

8. The cleaning head according to claim 7, wherein the open mouth of the inner compartment is of elongate configuration and said inner compartment extends across the suction chamber substantially parallel to the main axis thereof.

9. The cleaning head according to claim 8, wherein the open mouth of said inner compartment is located substantially centrally within the open mouth of the suction chamber whereby air-flow into the suction chamber takes place on both sides of the open mouth of the inner housing and the upper side of the body is spaced above the upper side of the inner housing by such a distance as to allow substantially unrestricted air-flow towards the outlet from both sides of the inner compartment.

10. The cleaning head according to claim 1, wherein said liquid distribution chamber is so dimensioned to serve as a storage reservoir within the cleaning head, for the cleaning liquid, which reservoir has a height sufficient to create a substantially equal hydrostatic head pressure at each of the outlet passageways.

11. The cleaning head according to claim 1, wherein said liquid distribution chamber has sufficient volume such that when substantially full a substantially equal flow rate of cleaning liquid from each of the outlet passageways can be achieved during application of the open mouth to a surface.

* * * * *